US010309753B2

(12) United States Patent
Forsythe et al.

(10) Patent No.: US 10,309,753 B2
(45) Date of Patent: Jun. 4, 2019

(54) PORTABLE LACHRYMATORY AND ELECTRICAL DEVICE

(71) Applicant: Forsythe & Storms Technologies LLC, Oak Creek, WI (US)

(72) Inventors: Lorne M. Forsythe, Oak Creek, WI (US); Christopher J. Storms, Milwaukee, WI (US); Joseph R. Patzer, Gillett, WI (US)

(73) Assignee: FORSYTHE & STORMS TECHNOLOGIES LLC, Oak Creek, WI (US)

( * ) Notice: Subject to any disclaimer, the term of this patent is extended or adjusted under 35 U.S.C. 154(b) by 0 days.

(21) Appl. No.: 15/679,380

(22) Filed: Aug. 17, 2017

(65) Prior Publication Data

US 2018/0051964 A1 Feb. 22, 2018

Related U.S. Application Data

(60) Provisional application No. 62/376,100, filed on Aug. 17, 2016.

(51) Int. Cl.

| | |
|---|---|
| ***B05B 9/01*** | (2006.01) |
| ***F41H 9/10*** | (2006.01) |
| ***B05B 9/04*** | (2006.01) |
| ***F41H 13/00*** | (2006.01) |

(52) U.S. Cl.

CPC ..... *F41H 9/10* (2013.01); *B05B 9/01* (2013.01); *B05B 9/0403* (2013.01); *F41H 13/0018* (2013.01)

(58) Field of Classification Search

CPC ..... F41H 9/10; F41H 13/0018; B05B 9/01; B05B 9/0403

USPC ..... 239/337

See application file for complete search history.

(56) References Cited

U.S. PATENT DOCUMENTS 4,058,921 A * 11/1977 Mason ..... F41C 23/10 222/79
4,220,443 A 9/1980 Bear
4,223,804 A * 9/1980 Morris ..... B65D 83/201 116/214
4,316,338 A * 2/1982 Mason ..... F41C 23/10 222/79
4,486,807 A * 12/1984 Yanez ..... F21V 33/0064 361/232

(Continued)

FOREIGN PATENT DOCUMENTS

CZ 283343 B6 3/1998
WO WO2012/074922 * 6/2012 ..... B05B 11/06

OTHER PUBLICATIONS

PhaZZer Electronics Inc. PhaZZer Enforcer Conducted Electrical Weapon (CEW) Models Output Characteristics and Features Data Sheet, dated May 1, 2017, pp. 1-2.

*Primary Examiner* — Chee-Chong Lee

(74) *Attorney, Agent, or Firm* — Husch Blackwell LLP

(57) ABSTRACT

The present disclosure provides a portable lachrymatory and electrical device. The portable lachrymatory and electrical device includes a fluid reservoir containing a lachrymatory composition, and a pump in fluid communication with the fluid reservoir and an orifice. The orifice is operable to emit a fluid stream trajectory of the lachrymatory composition there-through. The portable lachrymatory and electrical device also includes two terminals operable to deliver an electric potential between the two terminals.

8 Claims, 3 Drawing Sheets

(56) References Cited

U.S. PATENT DOCUMENTS 4,843,336 A * 6/1989 Kuo ..... F41B 15/04 340/321
4,846,044 A * 7/1989 Lahr ..... F41B 9/0031 89/1.11
4,884,809 A * 12/1989 Rowan ..... F41B 15/04 463/47.3
4,982,645 A * 1/1991 Abboud ..... F41B 15/04 42/1.08
5,409,638 A * 4/1995 Battochi ..... F41B 9/0031 106/1.11
5,635,908 A 6/1997 Soper
5,709,320 A 1/1998 Jimenez
5,921,442 A 7/1999 Keller et al.
6,439,432 B1 8/2002 Park
6,564,969 B1 5/2003 Loy
6,999,295 B2 2/2006 Watkins, III et al.
7,075,770 B1 7/2006 Smith
7,152,990 B2 12/2006 Kukuk
7,280,340 B2 10/2007 Smith et al.
7,580,237 B2 8/2009 Nerheim
7,624,898 B2 12/2009 Hornsby et al.
8,310,360 B2 11/2012 Ross et al.
8,363,376 B2 1/2013 Abatemarco
D681,768 S 5/2013 Ross et al.
D688,769 S 8/2013 Lord
8,985,397 B2 3/2015 Lord
8,988,229 B2 3/2015 Lord
9,174,231 B2 * 11/2015 Shultz ..... B05B 9/043
9,267,767 B2 2/2016 Hwang
2005/0098577 A1 5/2005 Huy et al.
2007/0194048 A1 8/2007 Teig
2008/0173257 A1 * 7/2008 Steiner ..... A01K 27/004 119/796
2009/0237857 A1 9/2009 Kao
2012/0298776 A1 11/2012 Yu

* cited by examiner

PORTABLE LACHRYMATORY AND ELECTRICAL DEVICE

BACKGROUND

The present disclosure relates to a portable lachrymatory and electrical device.

In recent years, there has been growing social unrest over law enforcement's use of lethal force against unarmed citizens. Thus, a growing demand exists for less-lethal technological alternatives in order to incapacitate and/or impeded the motion of aggressive, violent, combative, non-compliant, or high-risk subjects who pose a risk to law enforcement, military, corrections, private security, licensed citizens, the general public, and/or property.

There are various self-defense devices that are commercially available for this purpose, These include conventional firearms, audible alarms, batons, shotgun bean bags, pepper-ball projectiles, pepper sprays, multifunctional devices, conducted electrical weapons ("CEWs"), and stun guns.

Conventional pepper sprays, also known as OC spray or OC gas (from concentrated oleoresin capsicum ("OC")) are lachrymatory agents that use chemical compounds, typically contained in pressurized canisters, to irritate an assailant's eyes, sinuses, and nose, causing tears, pain, and temporary blindness. Temporary blindness is particularly useful for law enforcement as it allows them to restrain an assailant more easily. When used by civilians in self-defense scenarios, temporary blindness in a target can give the user the ability to flee a potentially life-threatening situation. Furthermore, chemical sprays are typically ranged devices, giving the user the ability to deter an assailant from as far away as 10 to 20 feet. Conventional pepper sprays are commercially available in a variety of sizes, often in compact pressurized canisters that can be concealed and/or used in multifunctional devices (i.e. flashlights, batons, portable audio devices, keychains, ornamental jewelry, etc.) Compact pressurized canisters allow the user to discretely carry the device in a purse or bag.

However, the pressurized canisters suffer from several disadvantages. For example, small compact pressurized canisters have very limited fluid ammunition and, as a result, have short continuous usage durations. The compact designs themselves can be a disadvantage because they can easily become lost in a bag or purse, were the victim might not able to find it quickly enough to prevent an attack. Moreover, after an initial usage, some propellant in the pressurized canister is lost, which can reduce reliability during future usages. Pressurized canisters can also leak and lose pressure over time, often with no indication of canister pressure to the user—so, the user has no idea if the device will operate properly when needed. Additionally, these pressurized canisters are generally filled and pressurized by the manufacturer, which prohibits a customer from refilling the fluid container/canister themselves; this can be an inconvenience to the user and can produce unnecessary waste.

Conventional multifunctional pepper spray devices tend to be cumbersome in design and can be more difficult to use than limited purpose devices. Conventional multifunctional pepper spray devices utilize two or more triggers, levers, and/or buttons to operate the different device features, which makes their operation difficult and/or confusing in a high stress situation. This added complexity not only creates unnecessary modes of failure in a device that requires a high degree of reliability, but also adds confusion with respect to proper device operation, particularly when used in a high stress situation. This can lead to unintended use of the device and/or rendering the device effectively useless when it is most needed. Unintended use can cause harm to the intended target, bystanders, and most importantly the user themselves, giving the attacker the advantage. Thus, these devices can be a liability concern for law enforcement departments and pose a risk to a user's safety if the device is misused or is discharged at the wrong target, including the user. Moreover, conventional multifunctional devices tend to sacrifice utility and aim accuracy for the purpose of being concealable and/or multifunctional in design, which can carry unnecessary risk.

Conventional CEWs generally have two operative mechanisms to create a physiologically effective electric shock impulse, which interferes with superficial muscle functions and/or causes short term pain to the intended target.

The first mechanism is a "stun gun," which induces a pain shock within the local receptor nerve endings in the surface layers of the tissues and muscles of the target without incapacitating the target. This is typically accomplished by contacting two terminals of an electrode to the target, which requires the user to be in close proximity to the target.

The second mechanism is an Electro-Muscular Disruption (EMD) device, which is designed to overcome the skeletal musculature of the target via penetration of current pulses into deep muscle layers. This is typically accomplished by firing two barbed dart projectiles, which penetrate the target and facilitate a shock via thin conductive wires in electrical contact between the device and the darts. The barbed end of the darts themselves are often constructed using fish hooks or similar geometry to ensure the dart both penetrates and stays in electrical contact with the target. Some EMD devices are outfitted with "drive stun" capability, in which the device may be held against a target, like a stun gun, without firing the barbed dart projectiles, while still causing a pain shock to the target.

Conventional CEW devices only allow for a limited number of projectile shots (typically one or two shots) before the cartridges are expended and must be replaced. This can pose a major safety risk to law enforcement and/or other users if the limited ammunition does not fire properly, a single dart does not make full contact with (or is not within close enough proximity to) the target, or any number of darts misses the target. In high-stress scenarios such as these, officers might then require alternative means of force, such as lethal conventional firearms and/or bludgeoning batons to protect themselves from a hostile target. A limited number of shots also prevent users from being able to use the CEW device on multiple targets, such as in scenarios where crowd/riot control is required, which is a disadvantage.

Additionally, the tethered barbed darts of CEWs that puncture the target are invasive and may need to be surgically removed from a target. Upon removal, the barbed darts can pose a blood-borne pathogen disease risk to others, including emergency medical technicians (EMTs) and hospital staff. Moreover, the barbed darts are considered medical sharps and must be disposed of as bio-hazardous waste.

Conventional CEWs can at times be inaccurate, especially as the range to the target increases. Inaccuracy can be partially caused by certain design features, as the two barbed darts are necessarily ejected away from the CEW with two slightly different initial vectors, usually between 6 to 8 degrees relative offset. The tethered barbed darts must hit the target at some non-zero displacement in order to cause an effective shock to the intended target. Another concern is that any inaccuracy, whether caused by poor aim or certain design features, can lead to unintended puncture wounds from the barbed darts to vital areas such as a target's eyes, face, head, throat, chest area, groin, genitals, breast, or areas of pre-existing injury.

A third, lesser-used operative mechanism for CEWs includes the use of conductive fluid to create a physiologically effective electric shock impulse. Conventional conductive fluid CEWs can be limited in some regards in that some devices use multiple fluids stored in separate containers, adding unnecessary complexity and modes of failure to the device. Additionally, conventional conductive fluid CEWs often struggle with maintaining the fluid stream cohesion necessary to remain electrically conductive over large distances, which depends on the mechanical design, the fluid(s) used, and the fluid additives used if any.

The art recognizes a need for a portable lachrymatory and electrical device that is user-friendly and reliable, and that can be used at ranged distances (i.e., greater than zero feet to less than or equal to 100 feet) as well as at relative zero displacement (i.e., within an arm's reach from the device to the target, including on contact (i.e., zero displacement)).

The art also recognizes a need for a portable lachrymatory and electrical device that minimizes and/or removes the unintended injury potential to the target the device is being used on, particularly from barbed dart and other solid-form projectiles (e.g., bean bags, pepper-balls, etc.), and/or reduces the need for the user to switch to alternative means of self-defense, such as conventional firearms.

The art also recognizes the need for a portable lachrymatory and electrical device that is capable of incapacitating and/or impeding the locomotion of a human or animal target without the need for tethered barbed darts.

The art also recognizes the need for a portable lachrymatory and electrical device that can consolidate currently separate devices and/or device features, which provides a tactical advantage in a high-stress situation (compared to operating two or more separate devices). Consolidation of currently separate devices and/or device features has the added advantage of providing improved equipment-belt real-estate opportunities for a user.

The art further recognizes the need for a portable lachrymatory and electrical device with a user-operable refill feature and extended usage duration.

SUMMARY

The present disclosure provides a portable lachrymatory and electrical device. The portable lachrymatory and electrical device includes a fluid reservoir containing a lachrymatory composition, and a pump in fluid communication with the fluid reservoir and an orifice. The orifice is operable to emit a fluid stream trajectory of the lachrymatory composition there-through. The portable lachrymatory and electrical device also includes two terminals operable to deliver an electric potential between the two terminals.

The present disclosure also provides a portable lachrymatory and electrical device including (A) a housing with a wall; (B) a fluid reservoir containing a lachrymatory composition, the fluid reservoir releasably attached to the housing via a clip attachment arm; (C) a pump fixed within the housing and in fluid communication with the fluid reservoir and. an orifice, the orifice operable to emit a fluid stream trajectory of the lachrymatory composition there-through; and (D) two terminals extending through the wall of the housing, the two terminals operable to deliver an electric potential between the two terminals.

DEFINITIONS

The numerical ranges disclosed herein include all values from, and including, the lower and upper value. For ranged containing explicit values (e.g., 1 or 2; or 3 to 5; or 6; or 7), any subrange between any two explicit values is included (e.g., 1 to 2; 2 to 6; 5 to 7; 3 to 7; 5 to 6; etc.).

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

Any reference to the Periodic Table of Elements is that as published by CRC Press, Inc., 1990-1991. Reference to a group of elements in this table is by the new notation for numbering groups.

Unless stated to the contrary, implicit from the context, or customary in the art, all parts and percentages are based on weight and all test methods are current as of the filing date of this disclosure.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

A "polymer" is a macromolecular compound prepared by polymerizing monomers of the same or different type. "Polymer" includes homopolymers, copolymers, terpolymers, interpolymers, and so on. An "interpolymer" is a polymer prepared by the polymerization of at least two types of monomers or comonomers. It includes, but is not limited to, copolymers (which usually refers to polymers prepared from two different types of monomers or comonomers, terpolymers (which usually refers to polymers prepared from three different types of monomers or comonomers), tetrapolymers (which usually refers to polymers prepared from four different types of monomers or comonomers), and the like.

A "lachrymatory agent" is a compound that causes eye, sinus, respiratory, and/or skin irritation.

DETAILED DESCRIPTION

Figure 1:
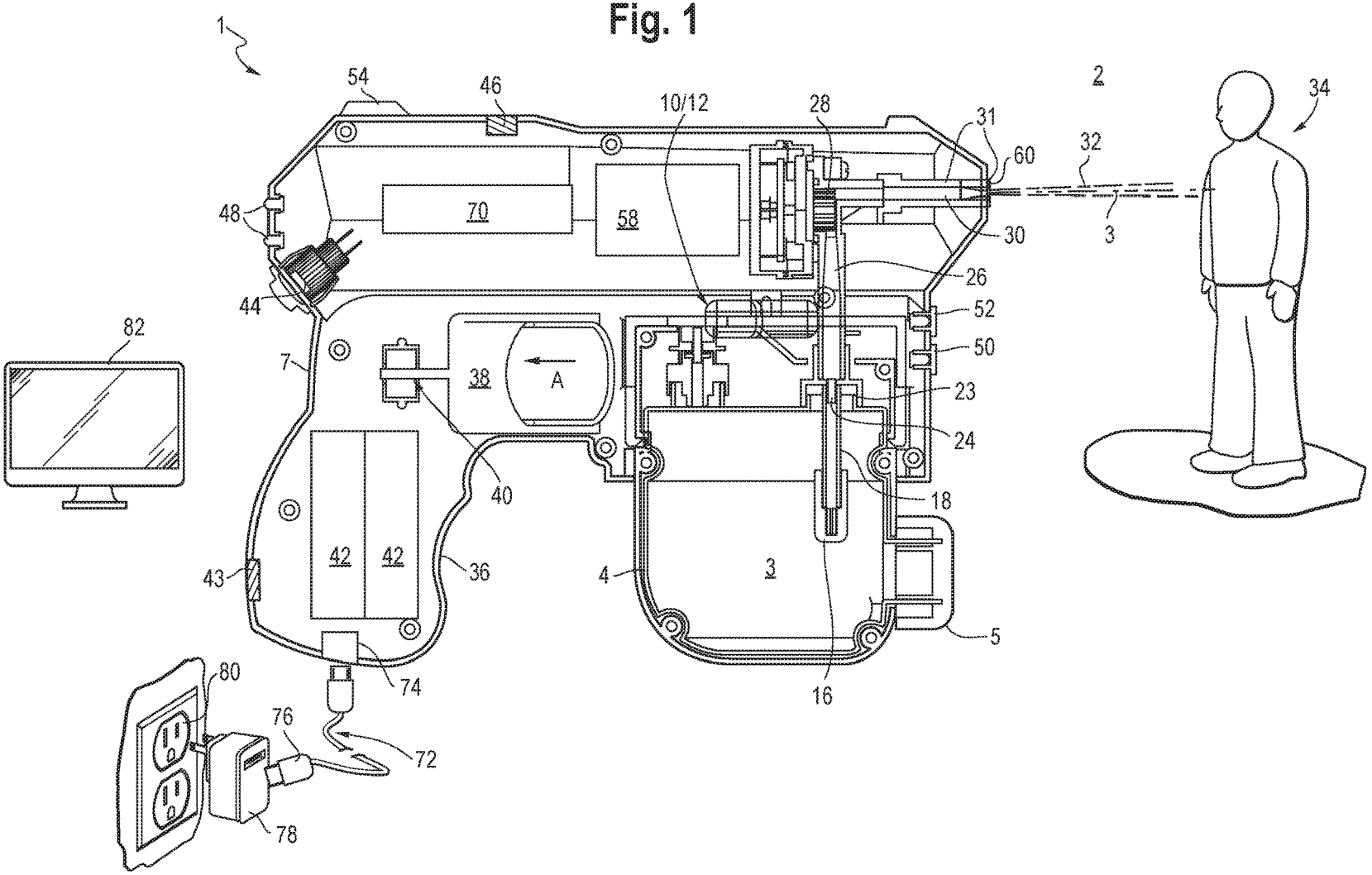
FIG. 1 is a cross-sectional view of a portable lachrymatory and electrical device in accordance with an embodiment of the present disclosure.
Figure 2:
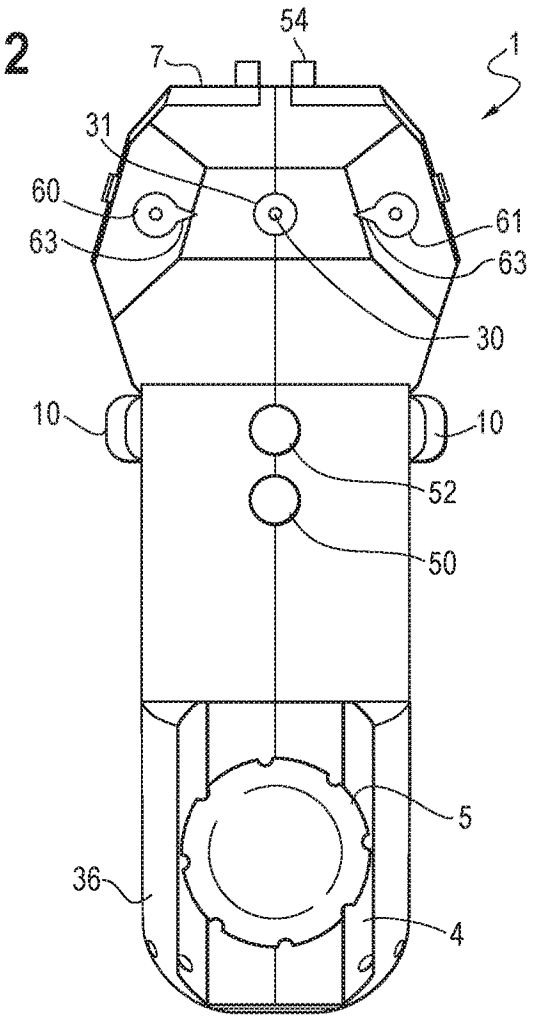
FIG. 2 is a front elevation view of the portable lachrymatory and electrical device in accordance with an embodiment of the present disclosure.

The present disclosure provides a portable lachrymatory and electrical device 1, as shown in FIGS. 1 and 2. The device includes a fluid reservoir 4 containing a lachrymatory composition 3 and a pump 28 in fluid communication with the fluid reservoir 4, and an orifice 30, the orifice 30 being operable to emit a fluid stream trajectory 32 of a lachrymatory composition 3 there-through. The device also includes two terminals (60, 61) operable to deliver an electric potential between the two terminals (60, 61).

One skilled in the art will recognize that an electric potential also allows for the possibility of electrical current to flow between the terminals (60, 61), contingent on the resistance/impedance between the terminals (60, 61).

The present portable lachrymatory and electrical device 1 is operable to incapacitate and/or impede the motion of a target 34 and cause temporary blindness and/or eye, sinus, respiratory, and/or skin irritation to a target 34. In an embodiment, the target 34 is a human or an animal.

Figure 3:
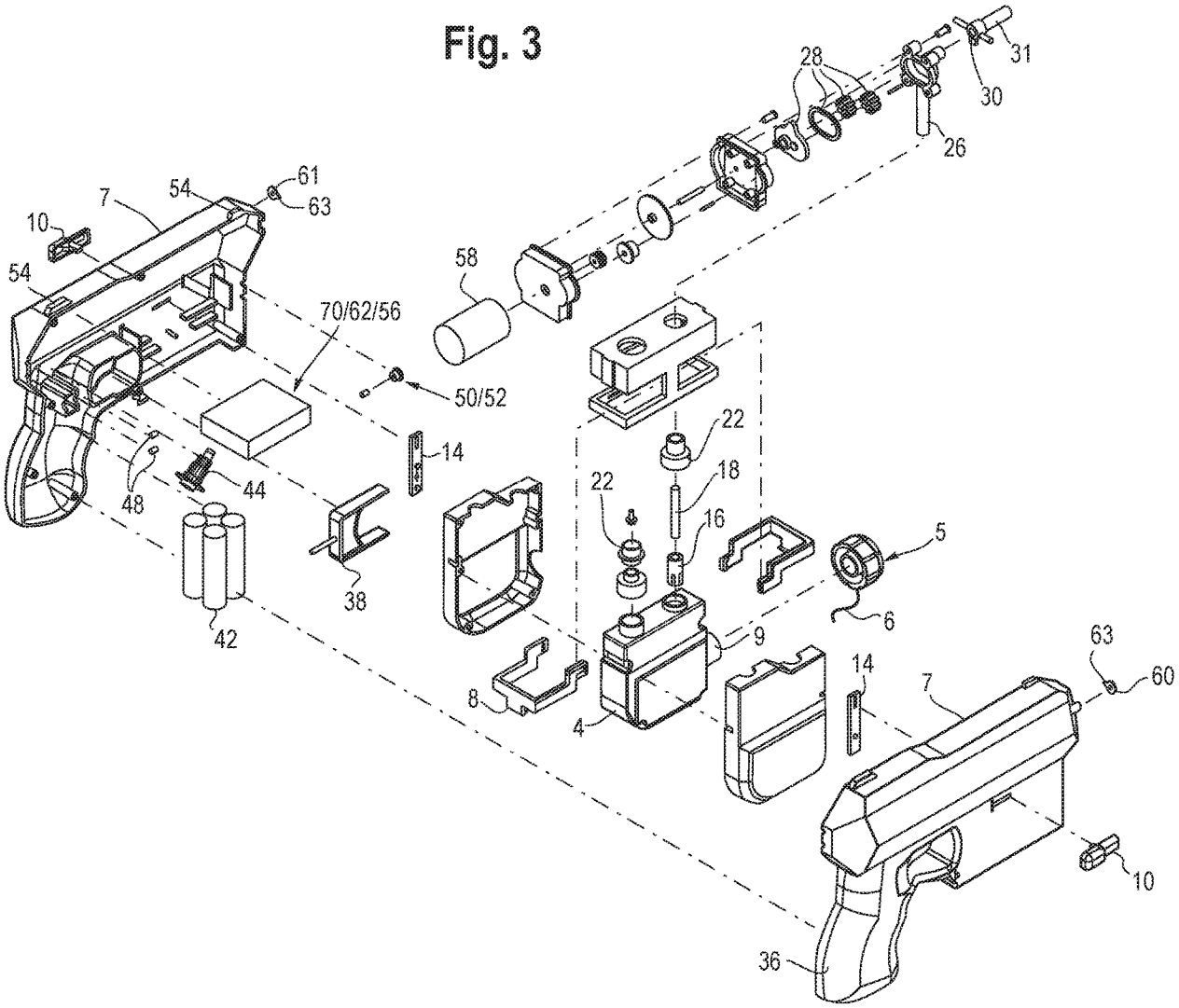
FIG. 3 is an exploded view of the portable lachrymatory and electrical device in accordance with an embodiment of the present disclosure.

FIG. 1 depicts a cross-sectional view of a portable lachrymatory and electrical device 1 in accordance with an embodiment of the present disclosure. FIG. 2 depicts a front elevation view of the portable lachrymatory and electrical device 1 of FIG. 1. FIG. 3 depicts an exploded view of the portable lachrymatory and electrical device in accordance with an embodiment of the present disclosure. It is understood that FIGS. 1, 2 and 3 only depict an embodiment of the present disclosure, and are not to be interpreted as limiting the disclosure in their scope.

A. Housing

The portable lachrymatory and electrical device 1 includes a housing 7.

The housing 7 is formed from one or more rigid materials. Nonlimiting examples of suitable rigid materials include high impact polymers, thermoplastic polymers, thermoset polymers, composites, metals, glass, ceramics, cellulose, rubber, combinations thereof, and/or the like. A "thermoplastic" polymer can be repeatedly softened and made flowable when heated and returned to a hard state when cooled to room temperature. In addition, thermoplastics can be molded or extruded into articles of any predetermined shape when heated to the softened state. A "thermoset" polymer, once in a hard state, is irreversibly in the hard state.

The housing 7 may have an integral design or a composite design. A housing 7 with an "integral design" is formed from one piece of rigid material, such as a molded piece. A housing with a "composite design" is formed from more than one distinct piece (or part), which upon assembly are combined to form the housing 7.

The housing 7 has an interior surface, an exterior surface, and a wall. The exterior surface of the housing 7 is in fluid communication with ambient environment 2.

In an embodiment, the housing 7 is formed in the shape of a pistol. A housing 7 in the shape of a pistol is advantageous because it is familiar and comfortable to conventional firearm users.

In an embodiment, the housing 7 includes a trigger guard. The trigger guard helps prevent accidental discharge caused by unintentional depression of the trigger 38.

The housing 7 may comprise two or more embodiments disclosed herein.

B. Aiming Sights

In an embodiment, the portable lachrymatory and electrical device I includes an aiming sight. The aiming sight aids a user in properly identifying the intended spot of impact of the fluid trajectory 32 on the intended target 34. Nonlimiting examples of suitable aiming sights include laser sights 52, mechanical sights 54, and combinations thereof. Nonlimiting examples of suitable laser sights 52 include red laser sights, green laser sights, blue laser sights, and infrared laser sights. Nonlimiting examples of suitable mechanical sights 54 includes projections from the exterior surface of the housing 7, illuminated sights, reflective sights, phosphorescent (i.e., glow-in-the-dark) sights, and combinations thereof.

In an embodiment, the sight apparatus is fixed to the exterior surface of the housing 7. In another embodiment, the sight apparatus is integral to the housing 7 such that the sight apparatus is formed as a unitary piece with the housing 7. In another embodiment, the sight apparatus extends through the wall of the housing 7 and is electrically connected to the electrical components contained in the electronics housing 70 and/or the battery 42.

In an embodiment, the portable lachrymatory and electrical device 1 includes a laser sight 52 and a mechanical sight 54.

The aiming sight (54, 52) may comprise two or more embodiments disclosed herein.

C. Fluid Reservoir

The portable lachrymatory and electrical device 1 includes a fluid reservoir 4.

The fluid reservoir 4 is formed from a rigid material. The rigid material may be any rigid material disclosed herein. The fluid reservoir 4 defines a chamber capable of containing a lachrymatory composition 3. Although FIG. 1 depicts a fluid reservoir 4 located within the bottom of the housing 7 and below the housing 7, it is understood that the fluid reservoir 4 may be located anywhere within the housing 7 and beside or above the housing 7, and combinations thereof. The portable lachrymatory and electrical device 1 includes from 1, or 2 to 3, or 4, or 5 fluid reservoirs 4. In an embodiment, the portable lachrymatory and electrical device 1 includes a single, or one and only one, fluid reservoir 4. The fluid reservoir 4 contains a lachrymatory composition 3.

The fluid reservoir 4 may be detachably connected to the housing 7 or fixed to and/or within the housing 7. FIG. 1 depicts a fluid reservoir 4 that is detachable. In an embodiment, a detachable fluid reservoir 4 is releasably attached to the housing 7 via a reservoir attachment arm 8 (also referred to as a clip attachment arm 8), which may or may not be spring loaded 12. The reservoir attachment arm 8 is part of or mounted within and/or on the housing 7. In an embodiment, the portable lachrymatory and electrical device 1 includes from 1, or 2, or 3, to 4, or 5, or 6, or 10, or 15, or 20 clip attachment arms 8. The detachable fluid reservoir 4 may be detached from the housing 7 using a mechanical lever 10, which is spring loaded 12 and mechanically coupled to a linkage assembly 14 that is mechanically connected to and operates the reservoir attachment arms 8. In an embodiment, the portable lachrymatory and electrical device 1 includes from 1 to 2, or 3, or 4 mechanical levers 10. In a further embodiment, the portable lachrymatory and electrical device 1 includes 2 mechanical leavers 10, wherein the mechanical levers 10 are on opposing sides of the portable lachrymatory and electrical device 1 such that a user may operate a mechanical lever 10 using either hand. A detachable fluid reservoir 4 is advantageous because it allows the user to quickly detach an empty fluid reservoir 4 and reload the portable lachrymatory and electrical device 1 with a full fluid reservoir 4 containing lachrymatory composition 3. This is especially useful in high-stress scenarios where quick response and short reload time is required. Moreover, detachable fluid reservoirs 4 enhance the portability of the portable lachrymatory and electrical device 1 by allowing the user to extend their overall lachrymatory composition 3 discharge time durations (i.e., the sum total of individual fluid reservoir 4 durations), thus reducing the need to switch to alternative means of self-defense such as conventional firearms. In an embodiment, the fluid reservoir 4 is filled with a lachrymatory composition 3 prior to being releasably attached to the housing 7.

In an embodiment, the fluid reservoir 4 has a refill opening 9 and a cap 5. The refill opening 9 is configured to receive the cap 5, to close or cover the refill opening 9. Nonlimiting examples of suitable caps 5 include screw caps, flip-top caps, snap caps, stop-cocks, thumb plungers, and other types of removable and reclosable closures. The refill opening 9 and cap 5 advantageously allow a user to add lachrymatory composition 3 to the fluid reservoir 4 and/or remove lachrymatory composition 3 from the fluid reservoir 4 when the cap 5 is open, or the refill opening 9 is otherwise uncovered. In an embodiment, the fluid reservoir 4 can be refilled with lachrymatory composition 3 through the refill opening 9 while the fluid reservoir 4 is attached to the housing 7 of the portable lachrymatory and electrical device 1. When the cap 5 is open, the interior of the fluid reservoir is in fluid communication with ambient environment 2. In an embodiment, the cap 5 is closed (i.e., not open). FIG. 1 depicts a closed cap 5.

In an embodiment, the cap 5 is connected to the fluid reservoir 4 via a tether 6. A tether 6 is a cord, fixture, or flexible attachment that anchors the cap 5 to the fluid reservoir 4.

The fluid reservoir 4 may comprise two or more embodiments disclosed herein.

D. Lachrymatory Agent

The fluid reservoir 4 contains a lachrymatory composition 3. A "lachrymatory composition" contains a lachrymatory agent, or a blend of lachrymatory agents. The lachrymatory composition 3 is in a liquid form (which includes a gel form), a gas form, or a combination thereof at standard ambient temperature and pressure (20° C. (68° F.) and an absolute pressure of 1 atm (14.696 psi)).

The lachrymatory composition 3 contains a lachrymatory agent. Nonlimiting examples of lachrymatory agents include capsaicinoids such as capsaicin and oleoresin capsaicin (OC), dibenzoxazepine (CR); phenacyl chloride (CN); 2-chlorobenzalmalononitrile (CS); nonivamide; bromoacetone; 2-butanol, propylene glycol; cyclohexane; dipropylene glycol methyl ether; carbon disulfide; ,syn-propanethial-S-oxide, and combinations thereof.

In an embodiment, the lachrymatory composition 3 contains a lachrymatory agent and water. In another embodiment, the lachrymatory composition 3 contains a lachrymatory agent, water, and an additive. In an embodiment, the lachrymatory composition 3 contains an additive selected from an electrolyte, a glycol, a glycerin, a luminous phosphorescent, a chemiluminescent agent, a dye, ethanol, and combinations thereof.

In an embodiment, the lachrymatory composition 3 contains an additive that is a luminous phosphorescent and/or a chemiluminescent agent. Luminous phosphorescents and chemiluminescent agents can aid users in no/low light scenarios by allowing them to see where the lachrymatory composition 3 is making contact with a target 34. Nonlimiting examples of suitable luminous phosphorescents include zinc sulfide, strontium aluminate, and combinations thereof. A nonlimiting example of a suitable chemiluminescent agent is luminal ($C_8H_7N_3O_2$) in an alkaline solution with hydrogen peroxide and an oxidizing agent such as iron, copper, or an auxiliary oxidant.

In an embodiment, the lachrymatory composition 3 contains an additive that is a glycol. Glycol minimizes the risk of the lachrymatory composition 3 freezing, as it can lower the effective freezing point of the lachrymatory composition 3. This is especially important for law enforcement officers when the device is exposed to sub-freezing temperatures for extended durations in winter conditions. Additionally, the inclusion of glycol in a lachrymatory composition 3 can result in a non-flammable lachrymatory composition 3. A non-flammable lachrymatory composition 3 is advantageous for the safe delivery of the fluid stream trajectory 32 to the target 34 when used in combination, or in sequence, with the electric terminals (60, 61). A nonlimiting example of a suitable glycol is propylene glycol.

In an embodiment, the lachrymatory composition 3 includes an additive that is a dye. Dyes can be used to aid law enforcement in marking and identifying a target 34 in a high stress scenario, which is particularly useful when large groups of people are present at the scene. Dyes also allow other people at the scene to recognize who the target 34 is so that they can stay away. Nonlimiting examples of suitable dyes include, but are not limited to, various colored dyes (e.g., blue, purple, pink, red, yellow, green, etc.) and ultraviolet (UV) tracer dyes.

In an embodiment, the lachrymatory composition 3 contains oleoresin capsaicin (OC), water, a dye, and a glycol.

In an embodiment, the lachrymatory composition 3 contains oleoresin capsaicin (OC), water, ethanol, a glycol (such as propylene glycol), and an optional dye.

In an embodiment, the lachrymatory composition 3 contains from greater than 0 wt %, or 0.01 wt %, or 0.05 wt %, or 0.10 wt % , or 0.15 wt %, or 0.18 wt %, or 0.20 wt % to 0.25 wt %, or 0.30 wt %, or 0.35 wt %, or 0.40 wt %, or 0.50 wt %, or 0.60 wt %, or 0.70 wt %, or 0.80 wt %, or 0.90 wt %, or 1.00 wt %, or 1.30 wt %, or 1.50 wt %, or 2.00 wt %, or 2.50wt %, or 3.00 wt %, or 3.50 wt %, or 4.00 wt %, or 4.50 wt %, or 5.00 wt %, or 10 wt %, or 15 wt %, or 20 wt %, or 25 wt %, or 50 wt %, or 75 wt %, or 99 wt %, or 100 wt % of the lachrymatory agent, based on the total weight of the lachrymatory composition 3. In another embodiment, the lachrymatory composition 3 contains from 1 wt %, to 2 wt %, or 3 wt %, or 5 wt %, or 10 wt %, or 15 wt %, or 20 wt % of the lachrymatory agent, based on the total weight of the lachrymatory composition 3.

In an embodiment, the fluid reservoir 4 contains from 20 milliliters (ml), or 30 ml, or 50 ml, or 80 ml, or 90 ml, or 100 ml, or 1,000 ml to 2,000 ml, or 3,000 ml, or 4,000 ml, or 5,000 ml, or 6,000 ml of the lachrymatory composition 3. In an embodiment, portable lachrymatory and electrical device 1 includes a fluid reservoir 4 having a capacity to contain from 20 ml to 6,000 ml, or from 70 ml to 80 ml, or from 70 ml to 150 ml of the lachrymatory composition 3.

The lachrymatory composition 3 may comprise two or more embodiments disclosed herein.

E. Battery

The portable lachrymatory and electrical device 1 includes a battery 42. The battery 42 is located within the housing 7. The battery 42 may be located anywhere within the housing 7.

In an embodiment, the portable lachrymatory and electrical device 1 includes a plurality of batteries 42. In another embodiment, the portable lachrymatory and electrical device 1 includes one battery 42.

The battery 42 may be detachably connected within the housing 7 or fixed within the housing 7. In an embodiment, the battery 42 is fixed or detachably connected within the housing 7, and the housing 7 includes a recharging port 74 such that a user may recharge the battery 42 through a power cord 72 connected to a power supply 80 such as a standard AC power outlet, via an adapter 78.

In another embodiment, the battery 42 is fixed or detachably connected within the housing 7 and the battery 42 may be recharged via inductive coupling (i.e., wireless charging) through the housing 7 wall to a wireless power supply connected to an AC outlet 80. Inductive coupling has several advantages such as, but not limited to, decoupling the battery 42 from the power supply 80, which helps protect against power surges; protected connections, which lowers the corrosion and short circuit risk because the electronics are fully enclosed by the housing 7; increased durability, in part due to less wear on the device from not constantly attaching and detaching a charging cable; and increased convenience and better aesthetic quality due to the lack of cables.

In an embodiment, the battery 42 is detachably connected within the housing 7. In an embodiment, when a user pulls or depresses a battery cartridge release mechanism 43 (which may or may not be spring loaded), the detachable battery 42 is at least partially ejected, or fully ejected, from the housing 7. A user can then replace a used ejected battery 42 with a fresh, charged battery 42.

Nonlimiting examples of suitable batteries 42 include zinc-carbon batteries, alkaline batteries, lithium batteries (such as lithium ion batteries), nickel-cadmium (NiCd) batteries, nickel-metal hydride (NiMH) batteries, mercury batteries, silver oxide batteries, and combinations thereof. The battery 42 may have a single cell, or may be a multi-cell battery. Nonlimiting examples of suitable commercially available batteries include those sold as AAA, AA, C, and D batteries.

In an embodiment, the battery 42 has a voltage from 3 volts (V), or 5 V, or 7.2V, or 8 V, or 9V to 10 V, or 12 V, or 15 V. In an embodiment, the battery 42 has a voltage equal to or greater than 3 V.

The battery 42 may comprise two or more embodiments disclosed herein.

F. Electrical Components

In an embodiment, the portable lachrymatory and electrical device 1 includes electrical components. The electrical components may or may not be contained within an electronics housing 70.

In an embodiment, the portable lachrymatory and electrical device 1 includes an electronics housing 70. The electronics housing 70 is formed from a rigid non-conductive material and is located anywhere within the housing 7. In an embodiment, the electronics housing 70 prevents the possibility of sensitive electrical components being exposed to external conditions such as, but not limited to, particulates, oxygen, humidity, rain, internal fluid leakage, and/or spillage from refills. Such exposure could cause direct damage to electrical components and/or result in corrosion, which could also damage electrical components.

In another embodiment, one or more, or all, of the electrical components are not contained in an electronics housing 70, but are instead individually located anywhere within the housing 7. It is understood that the descriptions of the electrical components contained in the electronics housing 70, and the connections (e.g., electrical connections) between electrical components contained in the electronics housing 70 and other components of the present portable lachrymatory and electrical device 1 also apply to electrical components individually located within the housing 7.

Nonlimiting examples of electrical components (which may or may not be contained in the electronics housing 70) include one or more of the following: power converters; transformers 62; microprocessors; solid state memories; hard drives; circuit boards; device usage and operational parameters data collection components and associated interface devices (e.g., devices to measure and track stun-gun outputs (such as voltage, current, resistance, impedance, inductance, reactance, and combinations thereof), the number of trigger pulls, the duration of each trigger pull, settings selection position for each trigger pull, time and date of each trigger pull, and other relevant data that may be of use); various electronic circuitry necessary to power the components of the portable lachrymatory and electrical device 1 such as components that provide safety interlocks, collect and report battery charge level, and various other features; an automatic timer (also known as an internal clock); a motor-controller circuit 56; an electric motor 58; and combinations thereof. In an embodiment, the portable lachrymatory and electrical device 1 includes a power converter and a transformer 62, which are electrically connected to the stun-gun terminals (60, 61) and together supply the terminals (60, 61) with a voltage. One skilled in the art will recognize that an electric potential also allows for the possibility of electrical current to flow between the terminals (60, 61), contingent on the resistance/impedance between the terminals (60, 61). In an embodiment, the power converter and transformer 62 step-up the voltage coming from the battery 42 to a relatively higher voltage output waveform. In an embodiment, the portable lachrymatory and electrical device 1 has a peak voltage from 5,000 V, or 10,000 V, or 20,000 V, or 30,000 V, or 40,000 V, or 45,000 V to 50,000 V, or 55,000 V, or 60,000 V, or 70,000 V, or 75,000 V, or 100,000 V, or 200,000 V, or 500,000 V, or 1,000,000 V. In another embodiment, the portable lachrymatory and electrical device 1 has a peak voltage from 40,000 V to 100,000 V. In another embodiment, the portable lachrymatory and electrical device 1 has a peak voltage from 45,000 V to 60,000 V. In an embodiment, a discharge waveform with an approximate pulse rate from 10, or 15 to 25, or 30 pulses per second (PPS) is used.

The electrical components are electrically connected to the battery 42. Nonlimiting examples of other electrical components that may be electrically connected to the battery 42 include an electric motor 58, a motor control circuit 56, the pump 28, a safety setting selection switch 44, an electrical switch or pushbutton 40, a laser sight and/or flashlight setting button 46, battery charge indicator components, safety interlock components, and the terminals (60, 61). In an embodiment, the safety setting selection switch 44 may be used to select nonlimiting options of lachrymatory compositions spray, electrical shock, or combinations thereof. In another embodiment, the flashlight and/or laser sight setting button 46 may be used to select nonlimiting options of turning the flashlight 50 on, turning the laser sight 52 on, or combinations thereof. In another embodiment, the electrical components contained in the electronics housing 70 are also electrically connected to at least one of an indicator light or display screen 48, an LED flashlight 50, and/or a laser sight 52. Nonlimiting examples of suitable electrical connections are disclosed in U.S. Provisional Patent Application No. 62/376,100, filed 17 Aug. 2016, the entire contents of which are herein incorporated by reference.

In an embodiment, the electronics housing 70 contains an automatic timer, which may be a digital timer or an analog timer. The automatic timer measures the duration of a complete electrical circuit and breaks the circuit by shutting off power to the terminals (60, 61) and/or the pump 28 if the spring loaded trigger 38 is pulled for an extended period of time or for numerous (i.e., more than 1) sequential trigger pulls activating the stun-gun feature prior to the portable lachrymatory and electrical device 1 being powered off. The automatic timer advantageously helps prevent permanent injury or death to the target 34, and/or damage to the portable lachrymatory and electrical device 1.

In an embodiment, the power cord 72 is operable to connect the present portable lachrymatory and electrical device 1 to a computer 82 or a mobile device (e.g., a cell phone, laptop, or tablet) such as through a USB (Universal Serial Bus) connector 76. Device usage and operational parameters data the various stun-gun energy outputs, the number of trigger pulls, the duration of each trigger pull, settings selection position for each trigger pull, time and date of each trigger pull, and other relevant data that may be of use) may be transferred to the computer 82 or mobile device through the power cord 72. In another embodiment, the device usage and operational parameters data may be transferred to the computer 82 or mobile device wirelessly, such as via Bluetooth, Wireless Fidelity (WiFi), or combinations thereof.

The electronics housing 70 and electrical components may comprise two or more embodiments disclosed herein.

G. Safety Setting Selection Switch

In an embodiment, the portable lachrymatory and electrical device 1 includes a safety setting selection switch 44. In an embodiment the safety setting selection switch 44 may be analog or digital. In either form, the safety setting selection switch 44 can be operated to switch between available modes. Nonlimiting examples of available modes include the options of lachrymatory composition spray, electrical shock, and combinations thereof. Nonlimiting examples of available modes also include those modes disclosed in U.S. Provisional Patent Application No. 62/376,100, filed 17 Aug. 2016, the entire contents of which are herein incorporated by reference. An indicator light and/or display 48 will visibly alert the user to the mode of the safety setting selection switch 44. In an embodiment, the indicator 48 is a colored LED, but may also be a display screen such as, but not limited to, a LCD display.

When the safety setting selection switch 44 is closed, the battery 42 powers the electrical components. In an embodiment, the battery 42 also powers a display 48 such as an LED status light, a flashlight 50 such as an LED flashlight, a laser sight 52, and combinations thereof, when the safety setting selection switch 44 is open or closed.

The safety setting selection switch 44 and laser sight and/or flashlight setting button 46 are visible to the user and operable from the exterior of the housing 7. In an embodiment, when a button/switch (44, 46) is pressed it will alter the indicator 48, providing the user with a visible indication of the status of the portable lachrymatory and electrical device 1.

The safety setting selection switch 44 and laser sight and/or flashlight setting button 46 may comprise two or more embodiments disclosed herein.

H. Flashlight

In an embodiment, a laser sight and/or flashlight setting button 46 is used to change the setting of a laser sight 52 and/or the functional setting of an LED flashlight 50. Nonlimiting examples of suitable settings include ON, OFF, and STROBE. In an embodiment, the flashlight 50 has a strobe feature that functions via circuitry enclosed in the electronics housing 70. The strobe flashlight feature can be advantageous because it can be used on its own to disorientate an attacker and give the user an advantage to either arrest the target 34 or flee the area. In an embodiment, the flashlight settings include a constant ON setting, which allows the user to see where they are going and/or to identify their target in a no-light or low light scenario, such as at night. In an embodiment, the flashlight settings include an OFF setting for when the flashlight 50 is not needed and/or for stealth operations.

In an embodiment, the flashlight 50 is oriented parallel to the fluid trajectory 32. The term "parallel," as used herein, indicates the flashlight 50 emits a light directed in the same direction, or substantially the same direction, as the fluid trajectory 32. FIG. 1 depicts a flashlight 50 oriented parallel to the fluid trajectory 32. When the flashlight 50 is oriented parallel to the fluid trajectory 32, the user can advantageously utilize the light emitted from the flashlight 50 to aim the portable lachrymatory and electrical device 1.

The portable lachrymatory and electrical device 1 may include more than one flashlight 50 and/or more than one flashlight setting buttons 46. In an embodiment, the portable lachrymatory and electrical device 1 includes from 1 to 2 flashlights 50. In another embodiment, the portable lachrymatory and electrical device 1 includes from 1 to 2 flashlight setting buttons 46.

The flashlight 50, flashlight setting button 46, and associated electrical components may comprise two or more embodiments disclosed herein.

I. Spring Loaded Trigger

The portable lachrymatory and electrical device 1 includes a spring loaded trigger 38. The spring loaded trigger 38 operates an electrical switch or pushbutton 40. When a user pulls the spring loaded trigger 38, the electrical switch or pushbutton 40 is closed. When the spring loaded trigger 38 is in the released position, the electrical switch or pushbutton 40 is open. Moving the spring loaded trigger 38 in the direction of the arrow "A", shown in FIG. 1, closes the electrical switch or pushbutton 40. The trigger 38 is spring loaded to maintain tautness and prevent accidental closure of the electrical switch or pushbutton 40. Nonlimiting examples of suitable electrical connections and electrical circuits including the spring loaded trigger 38 and the safety setting selection switch 44 include those disclosed in U.S. Provisional Patent Application No. 62/376,100, filed 17 Aug. 2016, the entire contents of which are herein incorporated by reference.

In an embodiment, the portable lachrymatory and electrical device 1 includes a single spring loaded trigger 38 (i.e., one and only one spring loaded trigger 38).

The spring loaded trigger 38 may comprise two or more embodiments disclosed herein.

J. Hand Grip

In an embodiment, the portable lachrymatory and electrical device 1 includes a hand grip 36. In an embodiment, the hand grip 36 is formed from the housing 7 or fixed to the exterior surface of the housing 7. The hand grip 36 is formed from a rigid material. The rigid material may be any rigid material disclosed herein. In an embodiment, the hand grip 36 is shaped to provide comfort to a user while a user grasps the hand grip 36.

In an embodiment, a user can operate the safety setting selection switch 44 while holding the hand grip 36.

In an embodiment, a user can operate the spring loaded trigger 38 while holding the hand grip 36.

The hand grip 36 may or may not be interchangeable. In an embodiment, the hand grip 36 is interchangeable such that different sized hand grips 36 may be attached to the portable lachrymatory and electrical device 1. The ability to attach different sized hand grips 36 advantageously allows a wider variety of users (such as those with relatively smaller or relatively larger hands) to operate the portable lachrymatory and electrical device 1 with improved comfort, control, and ease.

In an embodiment, a grip material is on the hand grip 36. The grip material may surround, or partially surround the hand grip 36. The grip material enhances a user's comfort when the user grasps the hand grip 36 and/or minimizes the risk of the portable lachrymatory and electrical device 1 slipping from a user's hand. Nonlimiting examples of suitable grip materials includes rubber/latex, polymeric material, metal, cellulose, and combinations thereof. The grip material may be smooth or texturized, such as with bumps or ridges.

The hand grip 36 may comprise two or more embodiments disclosed herein.

K. Terminals

In an embodiment, the portable lachrymatory and electrical device 1 includes a positive terminal 60 operating with its corresponding negative terminal 61 (collectively the "terminals"). The skilled artisan recognizes that the terminals (60, 61) may or may not oscillate between positive and negative, which is why a specific polarity is not shown in FIG. 1. For purposes of this disclosure, when the terminals (60, 61) are referred to as a "positive terminal" or a "negative terminal," it is in reference to the potential of the terminals (60, 61) during one electrical discharge (or "arc") of the portable lachrymatory and electrical device 1, with the understanding that during another arc of the portable lachrymatory and electrical device 1, the potential of the terminals (60, 61) may or may not switch such that the positive terminal of a first arc becomes the negative terminal of a second arc. One skilled in the art will recognize that a single terminal may be effectively used as only a "positive" or "negative" terminal through the use of circuit design and/or components, such as but not limited to, various diodes which ensures current only flows in one particular direction.

The terminals (60, 61) extend through the wall of the housing 7. In an embodiment, the terminals (60, 61) extend from 1 mm, or 2 mm, or 3 mm, or 4 mm, or 5 mm, or 6 mm to 7 mm, or 8 mm, or 9 mm, or 10 mm, or 11 mm, or 12 mm, or 13 mm, or 14 mm, or 15 mm past the exterior surface of the housing 7. In other words, the terminals (60, 61) project beyond the exterior surface of the housing 7.

Although FIGS. 1, 2 and 3 depicts terminals (60, 61) in a horizontal configuration, whereby the terminals (60, 61) are side-by-side, it is understood that the terminals (60, 61) may have a vertical configuration, whereby one terminal 60 is located above the other terminal 61, or at any relative angle in between. In an embodiment, the terminals (60, 61) have a horizontal configuration, wherein the orifice 30 is positioned between the two terminals (60, 61), as shown in FIG. 3. A horizontal configuration of the terminals (60, 61) is advantageous because it minimizes dripping or leaking of the lachrymatory composition 3 directly onto the terminals (60, 61) from the orifice 30.

The terminals (60, 61) may be formed from a metal, a metal alloy, or metal plating. Nonlimiting examples of suitable metals, metal alloys, and metal plating include tungsten, aluminum, copper, molybdenum, nickel, chromium, manganese, niobium, palladium, titanium, platinum, gold, iron, zinc, brass, bronze, monel, inconel, hastelloy, cobalt base alloy, carbon steel, stainless steel, and combinations thereof.

The terminals (60, 61) may or may not be coated. A coating can prevent corrosion and/or damage to the terminals (61, 61). In an embodiment, the terminals (60, 61) are coated. A nonlimiting example of a suitable coating is a ceramic.

In an embodiment, each terminal (60, 61) includes a prong 63. The prongs 63 are arranged such that they are directed towards (or extend towards) one another, as shown in FIG. 2.

The two terminals (60, 61) are operable to deliver an electric potential between the terminals (60, 61). This may be accomplished via the opposing prongs 63 connected to the terminals (60, 61). The opposing prongs 63 that extend towards one another allows for a lower resistance in the air gap between the two terminals (60, 61) and their respective prongs 63, thus allowing an electric discharge to occur between the terminals (60, 61). When power is transferred to the terminals (60, 61), the electric arching effect occurs between the terminals (60, 61), thereby providing a stun gun feature to the portable lachrymatory and. electrical device 1. To utilize the stun gun feature, a user directly contacts a target 34 with the terminals (60, 61) (not shown in FIG. 1). The stun gun feature provides for direct contact pain compliance and/or incapacitation of a target 34.

The terminals (60, 61) may comprise two or more embodiments disclosed herein.

L. Pump

The portable lachrymatory and electrical device 1 includes a fluid pump 28. The pump 28 is located within the housing 7. The pump 28 may be located anywhere within the housing 7. Nonlimiting examples of suitable pumps include gear pumps, centrifugal pumps, reciprocating pumps, hose/tube pumps, screw type pumps, turbo pumps, air pumps, or any positive displacement pumps, impulse pumps, velocity pumps, and the like or combination of pumps thereof including series and/or parallel configurations. In an embodiment, the fluid pump 28 is driven by a motor.

The portable lachrymatory and electrical device 1 includes from 1, or 2 to 3, or 4 pumps 28. In an embodiment, the portable lachrymatory and electrical device 1 includes a single, or one and only one, pump 28.

In an embodiment, the pump 28 is a capillary pump or a gear type pump and the portable lachrymatory and electrical device 1 includes a motor-controller circuit 56 and a mechanical motor (not shown).

In an embodiment, the pump 28 is a capillary pump or a gear type pump and the portable lachrymatory and electrical device 1 includes an electric motor 58.

Power is transferred from the battery 42 to the pump 28, which may or may not utilize an intermediate motor controller circuit 56 and/or a gearbox and gears to reduce or increase the rotation rate between the motor (a mechanical motor or an electric motor 58) and the pump 28, when the electrical switch or pushbutton 40 is closed and the safety setting selection switch 44 is in a position that allows for a lachrymatory agent spray. In an embodiment, the pump 28 is driven directly by an electric motor 58, or indirectly through the use of gearing and/or a motor controller circuit 56.

In an embodiment, after power is transferred to the pump 28, the pump 28 creates a relative suction pressure with respect to the ambient environment 2 (i.e., a lower relative pressure than the ambient environment 2), which draws lachrymatory composition 3 contained in the fluid reservoir 4 into the pump 28. The pump 28 then pressurizes the drawn in lachrymatory composition 3 such that the pressurized lachrymatory composition 3 has a higher relative pressure than the ambient environment 2. Then, the pump 28 discharges the pressurized lachrymatory composition 3 through an orifice 30. In an embodiment, the lachrymatory composition 3 that is drawn into the pump 28 by the relative suction pressure, with respect to the ambient environment 2, passes through a mechanical filter 16 into a reservoir outlet tubing 18, and into a seal assembly (22, 23, 24) that includes a gasket 23 and a check valve 22 (which may or may not be spring loaded). The seal assembly (22, 23, 24) prevents leakage of lachrymatory composition 3 between the fluid reservoir 4 and the housing 7. The relatively higher pressure from the ambient environment 2 on the top of the spring loaded check valve 22 forces the valve open, allowing air from the ambient environment 2 to enter the fluid reservoir 4.

The pump 28 advantageously allows for a continuous and uninterrupted source of suction pressure on the lachrymatory composition 3 contained in the fluid reservoir 4. In contrast, conventional pepper spray devices and multifunctional lachrymatory devices traditionally require pressurized lachrymatory composition cartridges or canisters, which contain a limited amount of pressurized lachrymatory composition, or a piston a user must manually pump to build pressure, such as in a conventional toy water gun. Devices that utilize pressurized lachrymatory composition cartridges or canisters contain an additional component that a user must monitor, and replace or refill, adding complexity to the device. Devices that utilize a manual piston require a user to have at least one hand on the piston, which detracts from a user's ability to maneuver the device, and requires the user to monitor and manually control the pressure in the device, which is timely, inconvenient, and may result in inaccurate aim from operating the piston. The absence of a pressurized lachrymatory composition cartridge, a separate gas tank to provide pressure, and a piston allows the present portable lachrymatory and electrical device 1 to be more portable and more reliable than conventional lachrymatory composition multi-functional CEWs.

In an embodiment, the portable lachrymatory and electrical device 1 excludes a relatively higher pressurized (i.e., having a higher relative pressure than the pressure of the ambient environment 2) lachrymatory composition cartridge and/or canister.

The pump 28 may comprise two or more embodiments disclosed herein.

M. Outlet Seal Assembly

The pump creates a relative suction pressure (or a negative pressure), with respect to the ambient environment 2, on the lachrymatory composition 3, forcing it into the reservoir outlet tubing 18, and into an outlet seal assembly (22, 23, 24). In an embodiment the relative suction pressure, with respect to the ambient environment 2, forces the lachrymatory composition 3 through a mechanical filter 16 into reservoir outlet tubing 18, and into an outlet seal assembly (22, 23, 24). The mechanical filter 16 is operable to filter undissolved additives from the lachrymatory composition 3 and/or various other contaminants that would otherwise interfere with the flow of lachrymatory composition 3 and/or cause damage to the pump 28 and/or other components.

The outlet seal assembly (22, 23, 24) includes a gasket 23 or a plurality of gaskets 23, and a check valve 22, which prevents unwanted lachrymatory composition 3 leakage from the fluid reservoir 4 into the housing 7. The outlet seal assembly check valve 22 is held open via a mechanical depression 24. When the fluid reservoir 4 is a detachable fluid reservoir 4, the contact of the mechanical depression 24 onto the check valve 22, once the fluid reservoir 4 is releasably attached to the housing 7 and positively gripped with the clip attachment arm(s) 8, maintains the check valve 22 in an open position for lachrymatory composition 3 to flow through the check valve 22 of the outlet seal assembly.

After passing through the outlet seal assembly (22, 23, 24), the lachrymatory composition 3 passes through intermediary tubing 26. In an embodiment, after passing through the intermediary tubing 26 the lachrymatory composition 3 is ejected by the pump 28 through an orifice 30. In an embodiment, the intermediary tubing 26 is formed from a rigid material. The rigid material may be any rigid material disclosed herein. In an embodiment, the intermediary tubing 26 is formed from non-conductive material that may be rigid or flexible.

The outlet seal assembly (22, 23 24) may comprise two or more embodiments disclosed herein.

N. Orifice/Nozzle

A nozzle 31 contains an orifice 30. The nozzle 31 extends from the pump 28 through the housing 7, and the orifice 30 extends through the nozzle 31, such that the pump is in fluid communication with the ambient environment 2. In other words, the orifice 30 is a channel extending through the nozzle 31. The orifice 30 is operable to emit a fluid stream trajectory 32 of lachrymatory composition 3 there-through.

The orifice 30 has a shape from a cross-sectional view. Nonlimiting examples of suitable orifice 30 cross-sectional shapes include circle, oval, ovoid, triangle, square, rectangle, diamond, parallelogram, trapezoid, rhombus, pentagon, hexagon, octagon, nonagon, decagon, and star. FIG. 2 depicts an orifice 30 with a circular cross-sectional shape.

In an embodiment, the orifice 30 is a converging orifice having a conical shape, wherein the orifice 30 has two ends, and one end has a smaller diameter than the other end. When the orifice 30 has a conical shape, the fluid trajectory 32 exits the portable lachrymatory and electrical device 1 at the orifice 30 end with a smaller diameter. Nonlimiting examples of suitable orifice 30 types include converging, converging-diverging, de Laval, fireman's, smooth-bore, variable stream/constant flow, automatic variable flow and stream, and broken or aspirated stream.

The lachrymatory composition 3 passes through the orifice 30 before the lachrymatory composition 3 exits the portable lachrymatory and electrical device 1. The lachrymatory composition 3 exits the portable lachrymatory and electrical device 1 as a fluid stream trajectory 32. The fluid stream trajectory 32 contacts a target 34.

In an embodiment, the portable lachrymatory and electrical device 1 includes from 1, or 2, or 3 to 4, or 5, or 6 nozzles 31, each nozzle having one orifice 30, wherein each orifice 30 is operable to emit a fluid stream trajectory 32 of lachrymatory composition 3. FIGS. 1 and 3 depict a portable lachrymatory and electrical device 1 with one orifice 30 that is operable to emit a fluid stream trajectory 32. When the portable lachrymatory and electrical device 1 includes more than one orifice 30, the lachrymatory composition 3 is split into an equal number of fluid stream trajectories 32 after passing through the intermediary tubing 26 and/or the pump 28.

The orifice 30 may comprise two or more embodiments disclosed herein.

O. Target

When the lachrymatory composition 3 passes through the orifice 30 and through the fluid stream trajectory 32 that is in contact with a target 34, the lachrymatory composition 3 can irritate the target's eyes, sinuses, nose, and/or respiratory system, causing tears, pain, and/or temporary blindness. Temporary blindness is particularly useful for law enforcement as it allows them to restrain a target 34 more easily. When used by civilians in self-defense scenarios, temporary target 34 blindness can give the user the ability to flee a potentially life-threatening situation.

As discussed above, the lachrymatory composition 3 may contain one or more additives, such as a dye, a glycol, a glycerin, ethanol, or a luminous phosphorescent and/or a chemiluminescent agent. The additives can aid users with discharge stream and target visibility in no/low light scenarios by allowing users to see where the lachrymatory composition 3 fluid stream trajectory 32 is making contact with a target 34.

The two terminals (60, 61) provide a stun gun feature, allowing the portable lachrymatory and electrical device 1 to be pressed against the target 34 using a direct contact technique often used by law enforcement (such as when arresting suspects). Direct contact capabilities ensure the safety of the user in the event the portable lachrymatory and electrical device 1 runs out of lachrymatory composition 3 and cannot be refilled, or a detachable fluid reservoir 4 cannot be replaced quickly enough due to the severity of the high stress situation. During direct contact, the target 34 acts as resistive load in an electrical circuit. The electrical circuit is completed when the electrical current returns to the adjacent terminal (60 or 61) from the target 34.

A target 34 acting as a resistive load in an electrical circuit may be incapacitated and/or have their motion impeded as a result of a pain shock within the local receptor nerve endings in the surface layers of the tissues and muscles of the target 34. The target 34 may be a human or an animal.

After a user releases the spring loaded trigger 38, power to the pump 28 stops.

To completely turn off the portable lachrymatory and electrical device 1, the safety setting selection switch 44 is moved to the open position.

The portable lachrymatory and electrical device 1 advantageously provides two mechanisms for incapacitating and/or impeding the motion of a target 34: (i) direct contact with the target 34 using the stun gun feature and (ii) lachrymatory composition 3 fluid stream trajectory 32 contact with the target 34. Fluid stream trajectory 32 contact with the target 34 advantageously allows a user to incapacitate and/or impede the motion of a target 34 that is not within the user's reach. Furthermore, the fluid stream trajectory 32 contact allows the present portable lachrymatory and electrical device I to advantageously engage multiple targets 34.

The portable lachrymatory and electrical device 1 may comprise two or more embodiments disclosed herein.

It is specifically intended that the present invention not be limited to the embodiments and illustrations contained herein, but include modified forms of those embodiments including portions of the embodiments and combinations of elements of different embodiments as come within the scope of the following claims.

We claim:

1. A portable lachrymatory and electrical device comprising:

a housing comprising a wall;

a mechanical sight fixed to an exterior surface of the wall;

a rigid fluid reservoir comprising a lachrymatory composition, the rigid fluid reservoir releasably attached to the housing via a clip attachment arm that is spring loaded;

a pump fixed within the housing and in fluid communication with the rigid fluid reservoir and an orifice that is a converging orifice having a conical shape, the orifice operable to emit a fluid stream trajectory of the lachrymatory composition there-through, a reservoir outlet tubing in fluid communication with the pump, the rigid fluid reservoir, a mechanical filter, and a seal assembly comprising a spring loaded check valve;

the pump operable to create a relative suction pressure in the rigid fluid reservoir with respect to ambient environment, which (i) draws lachrymatory composition through the mechanical filter into the reservoir outlet tubing, and then into the seal assembly, and then into the pump, and (ii) opens the spring loaded check valve, allowing air from ambient environment to enter the rigid fluid reservoir;

a motor for driving operation of the pump, the motor electrically connected to a rechargeable battery;

two terminals extending through the wall of the housing, the two terminals operable to deliver an electric potential between the two terminals, the two terminals having a horizontal configuration and the orifice positioned between the two terminals, wherein a peak electric potential between the two terminals is from 45,000 V to 55,000 V; and a flashlight operable to emit a light through the wall, the flashlight oriented parallel to the fluid stream trajectory.

2. The portable lachrymatory and electrical device of claim 1, wherein the lachrymatory composition comprises a lachrymatory agent, water and an additive.

3. The portable lachrymatory and electrical device of claim 1, wherein the rigid fluid reservoir has a capacity to contain from 20 ml to 6,000 ml of the lachrymatory composition.

4. The portable lachrymatory and electrical device of claim 1 further comprising a laser sight.

5. The portable lachrymatory and electrical device of claim 1 further comprising a gearbox and gears operable to change a rotation rate between the motor and the pump.

6. The portable lachrymatory and electrical device of claim 1 further comprising an intermediate motor controller circuit electrically connected to the battery and the motor.

7. The portable lachrymatory and electrical device of claim 1 comprising a single pump.

8. The portable lachrymatory and electrical device of claim 1, wherein the device excludes a lachrymatory composition cartridge having a relative high pressure with respect to ambient environment.

* * * * *